United States Patent [19]

Knutsen

[11] 4,385,669

[45] May 31, 1983

[54] INTEGRAL BLADE CYLINDRICAL GUAGE STABILIZER REAMER

[76] Inventor: Paul Knutsen, 18 Varshaven Pl., NW., Calgary, Alberta, Canada, T3P 0E1

[21] Appl. No.: 309,048

[22] Filed: Oct. 6, 1981

[51] Int. Cl.[3] ..... E21B 10/44; E21B 10/56; E21B 17/22

[52] U.S. Cl. ..... 175/323; 175/325; 175/329; 308/4 A

[58] Field of Search ..... 175/325, 323, 329, 409, 175/410, 394; 308/4 A

[56] References Cited

U.S. PATENT DOCUMENTS

| | | | |
|---|---|---|---|
| 3,180,439 | 4/1965 | Deely | 175/325 X |
| 3,712,392 | 1/1973 | Gorgendiere | 175/325 |
| 3,833,077 | 9/1974 | Lavallee | 175/325 |
| 3,885,637 | 5/1975 | Veprintsev et al. | 175/329 |
| 3,978,993 | 9/1976 | Olson et al. | 175/325 |
| 4,043,611 | 8/1977 | Wallace | 308/4 A |
| 4,273,159 | 6/1981 | Bolton et al. | 175/325 X |

*Primary Examiner*—Stephen J. Novosad
*Assistant Examiner*—Joseph Falk
*Attorney, Agent, or Firm*—Murray & Whisenhunt

[57] ABSTRACT

This invention is directed to a stabilizer-reamer which is useful in drilling oil wells and holes in mineral formations. The stabilizer-reamer extends the life of the drill bit by maintaining the diameter of the hole to original specifications. The stabilizer-reamer comprises a stabilizer portion which reduces excessive lateral movement of the drill bit, a reamer portion which reams away undersize portions of the walls of the hole and a rock chip grinding portion which breaks down oversize rock chips in the hole.

12 Claims, 5 Drawing Figures

INTEGRAL BLADE CYLINDRICAL GAUGE STABILIZER REAMER

FIELD OF THE INVENTION

This invention is directed to a stabilizer-reamer which is useful in drilling oil and gas wells and exploratory holes in mineral formations. More particularly, this invention is directed to a stabilizer-reamer which has longer life than conventional stabilizer-reamer combinations while maintaining the diameter of the hole to original specifications.

BACKGROUND OF THE INVENTION

For many years, it has been known to use a stabilizer or a reamer, or both in combination, in association with a drill bit as part of the drill string used in drilling a hole in the ground such as in the drilling of an oil well. The stabilizer reduces the lateral movement of the drill bit as it works its way through rock formation.

The function of the reamer is to maintain the diameter of the hole as the drill bit proceeds downwardly through the rock formation. As the oil well hole is being drilled, the rock drill bit gradually wears to undersize and thus the hole which is cut gradually becomes of undersize diameter. The function of the reamer, which has a hardened surface, is to grind the circumference of the hole, shortly after it has been cut by the rock drill bit, and thus keep the hole diameter to size.

Numerous stabilizer and reamer designs are disclosed in the prior art. Some are disclosed in the following list of United States patents:

| U.S. Pat. No. | Inventor | Issue Date |
|---|---|---|
| 2,419,901 | W. G. Lake | April 30, 1945 |
| 2,708,104 | D. C. McAllister | Nov. 22, 1950 |
| 3,575,247 | Robijn Feenstra | April 20, 1971 |
| 3,851,719 | Thompson et al. | Dec. 3, 1974 |
| 4,073,354 | Rowley et al. | Feb. 14, 1978 |
| 4,140,189 | Garner | Feb. 20, 1979 |
| 4,190,124 | Terry | Feb. 26, 1980 |

A well-known and widely used stabilizer-reamer is sold under the trade mark SR3 by Christensen Corporation, Salt Lake City, Utah. This stabilizer-reamer has an upper section which acts as the stabilizer. Vertical spiral grooves are present therein for permitting drilling mud and cut rock chips to pass upwardly through the annular space between the drill bit and the wall of the hole. The lower section of the stabilizer-reamer has countersunk therein three or more vertically disposed roller-cutters with hardened buttons embedded in the surface of the roller cutters. One problem with these roller cutters is that under the severe stress and shock conditions encountered in drilling through a rock formation, the pins upon which the rollers rotate become worn with time. Indeed, in some cases, the pins may eventually break away from the reamer section of the stabilizer-reamer and fall down the hole. One or more of the rollers may also fall down the hole. This is a very serious and costly problem because the rollers and pins at the bottom of the hole prevent the drill bit from biting the rock and cutting the hole. The only way to effectively deal with the problem is to make a trip by withdrawing the drill bit from the hole and then send expensive fishing equipment down the hole in order to grasp and withdraw the roller and pin from the hole.

Another problem with the roller cutters is that because they wear quickly, they do not last the length of time that it takes to drill the hole to total depth. Consequently, during several of the numerous trips that are made in the drilling of an oil well, the rollers must be replaced, thereby causing expensive maintenance time.

A recent development in rock drill bit design, replacing the traditional tri-cone bit, in some cases, has been the inverted conical style. Such inverted conical bits are manufactured and sold under the trade mark TRI-MAX by International Petroleum Engineering Corporation, Norman, Okla. The advantage of these bits is that they purportedly last longer in the hole and drill faster, particularly through limestone formations. One problem with the inverted conical type bit, however, is that it tends to deviate laterally from the vertical, as the hole is being drilled. Keeping these bits more or less on line, therefore, has presented somewhat of a problem.

SUMMARY OF THE INVENTION

I have invented a stabilizer-reamer which provides greater control over undesirable lateral deviation of both inverted conical type and tri-conical drill bits, has no moving parts which have a tendency to break free and fall down the hole, or must be replaced during the time the hole is being drilled, simultaneously keeps the hole to size while stabilizing the drill bit against excessive lateral movement, and has longer durability than conventional reamer-stabilizer combinations.

The reamer section of the stabilizer-reamer has a unique bevelled surface with hardened buttons embedded therein. The lateral surface with the embedded hardened buttons act to grind to smaller size oversize rock chips and other debris that is encountered during the drilling of a typical oil well hole. This rock size reduction permits the rock chips to pass upwardly through the annular space between the drill stem and the hole by being carried by the drilling mud that is pumped down the centre-channel of the drill string.

My stabilizer-reamer design has at least the following significant advantages:

1. There are no moving parts to the stabilizer-reamer design which can break loose and fall down the hole as the hole is being drilled.
2. The stabilizer-reamer is less expensive to use than stabilizer-reamer combinations now available on the marketplace.
3. There is no need to replace any moving parts on the stabilizer-reamer as the hole is being drilled, the stabilizer-reamer being good for at least the length of time that it takes to drill a normal 3000–4000 meter oil well hole. Thus, expensive down time on the oil well hole is reduced.
4. Hardened buttons such as tungsten-carbide buttons or industrial diamond buttons protrude from the walls of the reamer section of the stabilizer-reamer and thereby provide a cutting action on the walls of the hole. The protruding buttons enable the stabilizer-reamer to maintain to size any portions of the walls of the hole that are undersize.
5. The stabilizer-reamer is especially useful in association with inverted conical type drill bits by keeping such drill bits on a generally vertical-line as the hole is being drilled.
6. The stabilizer-reamer stabilizes against excessive lateral movement of the bit so that it is not subjected to excessive lateral stress and shock forces which tend to wear out the drill bit at a rapid rate.

7. The stabilizer-reamer has thereon a bevelled surface, with hardened buttons embedded therein, which together act to grind up oversize rock chips and debris so that they can be cleared from the drilling region of the hole by drilling mud pumped down the hole.
8. The one-piece construction results in a stiffer stronger bottom hole assembly with no moving parts to wear out or break down. The stiffness reduces bit wobble and thereby extends the life of the bearings in the drill bit.
9. The number of trips that are required in drilling a hole are reduced because the life of the bit is prolonged. Rig down-time is therefore reduced.

The invention is directed to a stabilizer-reamer for use in association with drill stem and a drill bit in drilling a hole in a rock formation comprising in combination: (a) means for stabilizing the drill stem and drill bit against excessive lateral movement within the hole, (b) means for reaming the wall of the hole when it is of a diameter less than the diameter of the stabilizer (a), and (c) means for grinding to smaller size pieces of rock encountered in drilling the hole in the formation.

The stabilizer-reamer may be of a generally cylindrical shape, of a given diameter, the stabilizer means (a) comprising a portion of the shape including a portion of the curved surface of the shape with the given diameter, the reamer means (b) comprising another portion of the shape including a portion of the curved surface, the diameter of the curved surface of the reamer means (a) being sized of slightly smaller diameter than the diameter of the curved surface of the stabilizer means (a) and the hole being drilled, the curved surface of the reamer means (b) having thereon at least one hardened member which protrudes from the curved surface of means (b), equal to the reduction in radius between the curved surfaces of means (a) and means (b).

In the stabilizer-reamer, means (c) may have thereon a plurality of discretely disposed elements which are sufficiently hard to crush rock encountered in the drilling of the hole through the rock formation.

In the stabilizer-reamer, the hardened elements may be tungsten-carbide, industrial diamond, or other suitable grinding materials. At least one spiral groove may exist in and interconnect the surfaces of the stabilizer means (a) and the reamer means (b).

The stabilizer means (a) may be cylindrical in shape, the reamer means (b) may adjoin the stabilizer means and be cylindrical in shape, and have the same axis as the stabilizer means (a), the radius of the reamer means (b) being undersized relative to the radius of the stabilizer means (a), and the reamer means (b) having disposed on the curved surface thereof at least one hardened particle which extends radially to an extent that the combined radius of the curved surface of the reamer means (b) and the hardened particle is equal to the radius of the stabilizer means (a).

In the stabilizer-reamer, a plurality of hardened elements may be disposed on the curved surface of the reamer means (b). The grinding means (c) may adjoin the reamer means (b) on the side removed from the stabilizer means (a), and may have a surface which is bevelled relative to the curved surface of the reamer means (b) and may have disposed thereon at least one hardened element.

The stabilizer means (a) may have a hardened surface, and may have at least one hardened element embedded therein.

DRAWINGS

DETAILED DESCRIPTION OF AN EMBODIMENT OF THE INVENTION

Figure 1:
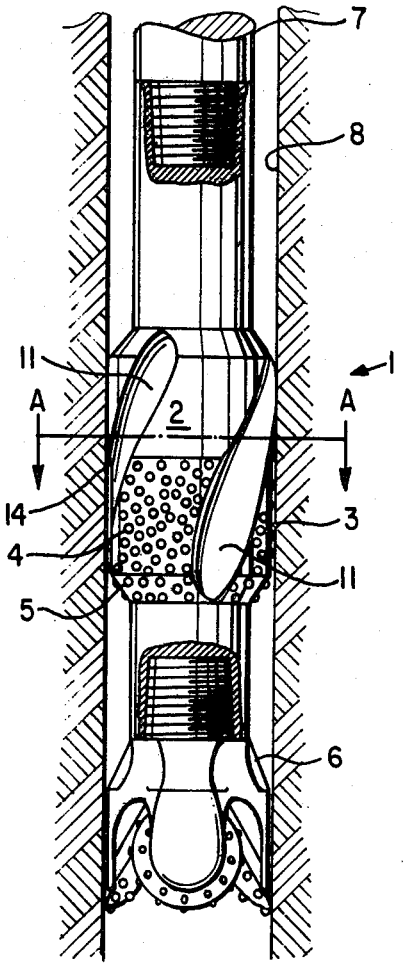
FIG. 1 represents a side elevation view of the stabilizer-reamer in combination with a drill bit assembly in an oil well hole.

As can be seen in FIG. 1, the stabilizer-reamer 1 consists basically of two generally equally-sized sections, a stabilizer section 2 and a reamer section 3. The surface of the reamer section 3 has embedded therein a plurality of hardened buttons 4, which can be constructed of any suitable hardened material such as tungsten-carbide or industrial diamond. A part of the reamer section 3, removed from the stabilizer section 2, has a bevelled face 5, the surface of which also has embedded therein a series of hardened buttons 4.

As illustrated in FIG. 1, the stabilizer-reamer 1 is shown attached as a component immediately above a drill bit 6. The drill bit 6 which is shown is the conventional tri-conical design of drill bit. The stabilizer-reamer 1 has screwed therein in the female threaded socket at its top a conventional drill collar 7, which forms part of the drill string. The combination is shown being used to drill through rock formation 8. A plurality of helical grooves 11 are shown extending upwardly along the surface length of the stabilizer-reamer 1. These grooves 11 are for the purpose of transmitting upwardly in the hole drilling mud and rock chips that are cut by the drill bit 6 as the hole is being cut downwardly through the rock formation 8. The drilling mud is pumped from the surface downwardly to the bottom of the hole through a channel in the centre of the drill string.

The vertical surface of the reamer section 3 is milled slightly under diametrical size in comparison with the diameter of the stabilizer section 2. This reduction commences at reduction point 14. However, the buttons 4 protrude from the surface of the reamer section 3 a distance equivalent to the reduction in diameter of the reamer section 3 compared to the stabilizer section 2. As a consequence, the diameter of the protruding buttons 4 in combination with the reamer section 3 is the same as the diameter of the stabilizer section 2.

Figure 2:
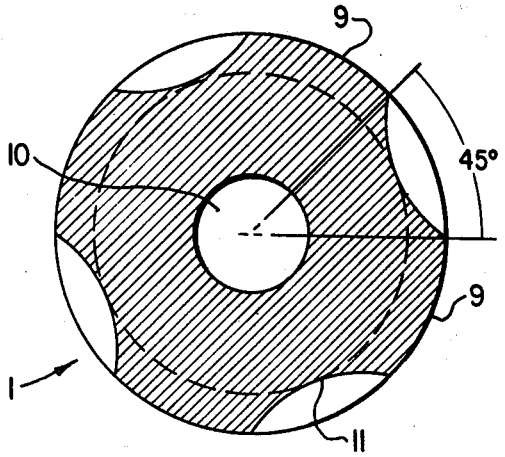
FIG. 2 represents a section view taken along section line A—A of FIG. 1.

FIG. 2 represents a section view of the stabilizer-reamer 1 as taken along section line A—A of FIG. 1. This view shows the generally circular configuration of the stabilizer-reamer 1 and in particular, the construction of the helical grooves 11. Also shown is the circular mud channel 10 that exists axially within the stabilizer reamer 1. Channel 10 is for the transmission of drilling mud from the hollow drill stem that is connected above the stabilizer-reamer 1, through the stabilizer-reamer 1, and then through the interior of the drill bit 6 or other drill stem equipment that is connected below the stabilizer-reamer 1. The mud collects rock chips and other debris encountered in the drilling of the hole and carries it up to the surface through the annular space that exists between the rock face 8 and the drill string.

Figure 3:
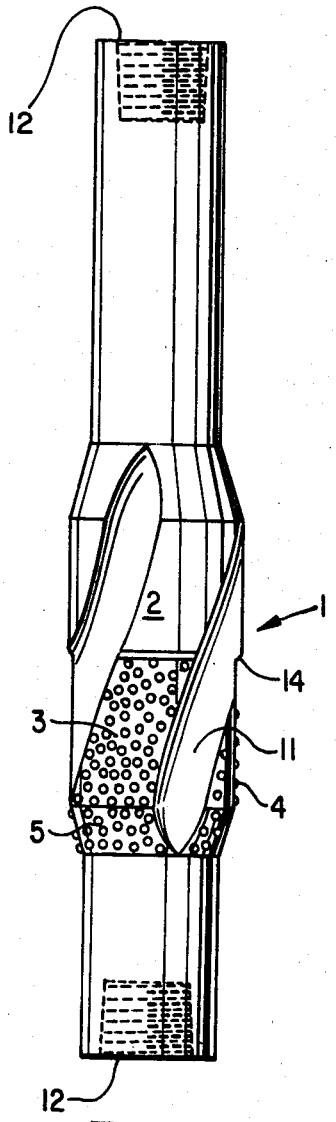
FIG. 3 represents a side elevation view of the stabilizer-reamer, as adapted for use with a drill bit.

FIG. 3 illustrates a stabilizer-reamer 1 which has at the bottom and top ends thereof threaded box connections 12. This design is adapted for connection to a drill bit 6 immediately below it, and a drill collar 7 immediately above it. This design is similar to that shown in FIG. 1.

Figure 4:
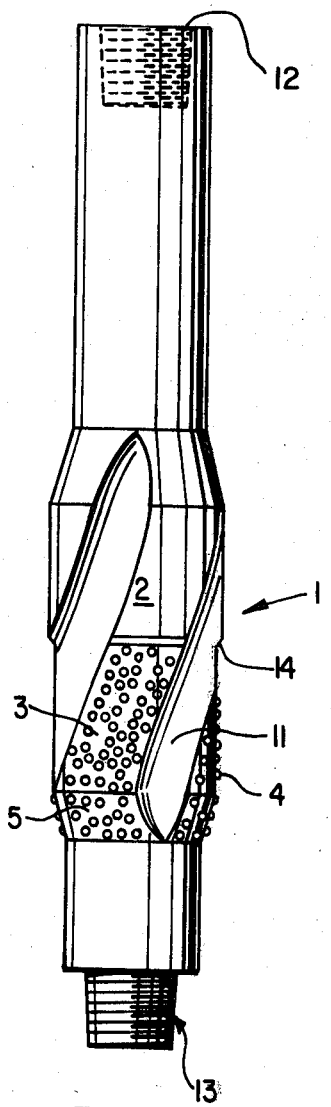
FIG. 4 represents a side elevation view of the stabilizer-reamer, as adapted for use as part of the drill string.

The stabilizer-reamer 1 illustrated in FIG. 4 is constructed to have a box connection 12 at the top thereof, but a threaded pin connection 13 at the bottom thereof. This design is used when the stabilizer-reamer 1 comprises part of the drill stem string generally, rather than when it is positioned immediately above the drill bit 6. This design is useful when it is required to place a stabilizer-reamer 1 somewhere along the intermediate length of the drill string in order to stabilize the drill stem at that point, or to provide a back-up in reaming the walls of the drill hole in order to maintain it to size.

Figure 5:
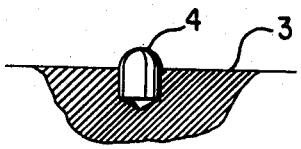
FIG. 5 (which is shown on the same sheet as FIG. 2) represents a cut-away view of a hardened button embedded in the surface of the reamer section of the stabilizer-reamer.

FIG. 5 illustrates the manner in which a hardened button 4 is embedded in the surface of the reamer section 3. The button 4 is counter sunk in the reamer section 3. These hardened buttons 4 can be tungsten-carbide, industrial diamond, or some other suitable hardened material capable of cutting into the walls of a hole drilled through rock.

FIGS. 1, 3 and 4 clearly show that the diameter of the surface of the stabilizer section 2 is greater than the diameter of the reamer section 3. The diameter of the reamer section 3 is reduced to an appropriate point where, once the hardened buttons 4 are installed, the tips of the buttons 4, in combination with the surface area of the reamer section 3, diametrically extend to a distance which is identical to the diameter of stabilizer section 2. Consequently, as the drill bit 6 is rotated in the hole, and grinds rock as it proceeds downwardly, the hardened buttons 4 travel circumferentially around the hole and cut away portions of the wall that are undersize. This happens, for example, if the bit 6 is worn away and has become undersize. The diameter of the stabilizer section 2, being sized to fit snugly in the hole, ensures that the drill stem and the rock bit are stabilized against excessive lateral movement within the hole. The surface of the stabilizer should be sufficiently hard to resist excessive wear during the course of drilling a conventional oil well of 4000 to 5000 meters. The surface can typically be a hardened metal such as a boride steel alloy, or be a drill steel with hardened buttons embedded therein. If buttons are used, they would be flush with the surface of the stabilizer.

The bevelled undersurface 5 of the reamer section 3 is advantageous in removing rock bits and debris between the drill bit and the stabilizer-reamer 1. For example, if any large rock pieces, or other debris, are cut away by the drill bit 6, or fall into the hole at the point above rock bit 6, but below reamer section 3, the hardened buttons 4 positioned on bevelled surface 5 grind these pieces into pieces sufficiently small that they can be carried upwardly along grooves 11 by the drilling mud that has pumped down the central hole 10 of the stabilizer-reamer 1.

Stabilizer-Reamer Test at Shell-Home (Waterton) 6-3, 6-3, W5

A prototype of the stabilizer-reamer was manufactured for a retail cost of about $5,250.00 Cdn. The prototype was manufactured by Rostel Industries Ltd., Calgary, Alberta. The prototype was constructed to be used in a drill hole measuring 8½ inches diameter. The surface of the stabilizer portion of the prototype was weld-coated with a hard boride-steel alloy and then lathed to size. The hardened buttons, 172 (one hundred seventy-two) were tungsten-carbide alloy.

The prototype was tested during the drilling of an oil well in the Waterton Lakes region of Alberta, Canada. The well is identified as Shell-Home (Waterton) 6-3, 6-3, W5.

The hole was first drilled to a depth of 2738 meters with an average diameter of 12¼ inches. intermediate casing was set in the hole to this depth. Then the hole was drilled with an 8½ inch diameter from a depth of 2738 meters to 4374 meters, using the prototype stabilizer-reamer together with conventional drilling equipment.

The prototype was then removed and the well was drilled to a final depth of 4843 meters using a conventional roller cutter reamer. In drilling the hole from a depth of 4374 to 4843 meters, three sets of cutter rollers were used on the conventional roller reamer.

During drilling, it was calculated that about 18,000 to 20,000 Deca-Newtons weight was exerted on the drill bit and the prototype stabilizer-reamer. (This represented about 36,000 to 40,000 pounds force.) Rotary speed of the bit ranged from 45 to 55 rpm. The degree of departure from vertical was measured at various points down the hole to range from 1¾ degrees to 7¾ degrees. This degree of departure was comparable to holes drilled with conventional roller cutter reamers.

During drilling of the well using the prototype, the bit encountered dolomite, limestone and chert formations. The latter is a very hard black or clear rock which is very tough and hard on drilling equipment including drill bits. The prototype was used for 50 days with a total of about 750 hours operation time.

The prototype was inspected after having been used in drilling the well from a depth of 2738 meters to 4374 meters. The diameter of the stabilizer portion was 1/32nd inch undersize when it first was lowered into the hole. After being used from a depth of 2738 meters to 4374 meters, the diameter of the stabilizer portion was measured to be 1/16th inch undersize. Thus the stabilizer portion wore down only 1/32nd inch during the distance drilled. Moreover, only about one-third of the one hundred seventy-four hardened buttons on the reamer portion were found to be undersize. The upper buttons located on the top 4 to 5 inches of the reamer section of the stabilizer-reamer were still up to size. On this basis, it was calculated that one stabilizer-reamer manufactured in accordance with the specifications of the prototype could be used in drilling a typical 3000 to 4000 meter oil well hole without having to replace the stabilizer-reamer.

Following this test, it was calculated that the following savings in costs would be made using the prototype in the drilling of a typical oil well hole. Normally, it was calculated that in drilling the hole in a conventional manner using roller cutter reamers, eight sets of cutter rollers would be required at a cost of $1,305.00 per set, totalling $10,440.00 Cdn. Furthermore, an average of about one hour per set would be required to replace worn roller cutters. Accordingly, based on an average drilling rig cost of $416.00 Cdn. per hour, the rig down time caused by changing eight sets of roller cutters would total at $3,228.00 Cdn. Therefore, the total cost involved if conventional roller cutters had been used was calculated to be approximately $13,770.00 Cdn. ($10,440.00+$3,328.00). Since the cost of the prototype was about $5,250.00 Cdn., and only one prototype would have been required to drill the hole to total depth, a total saving of approximately $8,520.00 would have been realized in using the prototype for the entire hole.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A stabilizer-reamer for use in association with drill stem and a drill bit in drilling a hole in a rock formation comprising in combination:

(a) means for stabilizing the drill stem and drill bit against excessive lateral movement within the hole;

(b) means for reaming the wall of the hole when it is of a diameter less than the diameter of the drill bit; and (c) means for grinding to smaller size pieces of rock encountered in drilling the hole in the formation and wherein the stabilizer-reamer is of a generally cylindrical shape, of a given diameter, the stabilizer means (a) comprising a portion of the shape including a portion of the curved surface of the shape with the given diameter, the reamer means (b) comprising another portion of the shape including a portion of the curved surface, the diameter of the curved surface of the reamer means (b) being sized of slightly smaller diameter than the diameter of the curved surface of the stabilizer means (a) and the hole being drilled, the curved surface of the reamer means (b) having thereon at least one hardened member which protrudes from the curved surface of means (a) and means (b).

2. A stabilizer-reamer as defined in claim 1 wherein means (c) has thereon a plurality of discretely disposed elements which are sufficiently hard to crush rock encountered in the drilling of the hole through the rock formation.

3. A stabilizer-reamer as defined in claim 1 wherein means (c) has thereon a plurality of discretely disposed elements which are sufficiently hard to crush rock encountered in the drilling of the hole through the rock formation.

4. A stabilizer-reamer as defined in claim 2 or 3 wherein the hardened elements are tungsten-carbide.

5. A stabilizer-reamer as defined in claim 2 or 3 wherein the hardened elements are industrial diamond.

6. A stabilizer-reamer as defined in claim 1 or 2 wherein at least one spiral groove exists in and interconnects the surfaces of the stabilizer means (a) and the reamer means (b).

7. A stabilizer-reamer as defined in claim 1 wherein the stabilizer means (a) is generally cylindrical in shape, the reamer means (b) adjoins the stabilizer means, is generally cylindrical in shape, and has the same axis as the stabilizer means (a), the radius of the reamer means (b) being undersized relative to the radius of the stabilizer means (a), and the reamer means (b) having disposed on the curved surface thereof at least one hardened particle which extends radially to an extent that the combined radius of the curved surface of the reamer means (b) and the hardened particle is equal to the radius of the stabilizer means (a).

8. A stabilizer-reamer as defined in claim 7 wherein a plurality of hardened elements are disposed on the curved surface of the reamer means (b).

9. A stabilizer-reamer as defined in claim 1, 7 or 8 wherein the grinding means (c) adjoins the reamer means (b) on the side removed from the stabilizer means (a), has a surface which is bevelled relative to the curved surface of the reamer means (b) and has disposed thereon at least one hardened element.

10. A stabilizer-reamer as defined in claim 1, 7 or 8 wherein the stabilizer means (a) has a hardened surface.

11. A stabilizer-reamer as defined in claim 1, 7 or 8 wherein the surface of the reamer means (b) has at least one hardened element embedded therein.

12. A stabilizer-reamer as defined in claim 1, 7 or 8 wherein the surface of the reamer means (b) has at least one hardened element embedded therein, the surface of which is flush with the surface of the stabilizer means (a).

* * * * *